US006429822B1

(12) United States Patent
Naudin et al.

(10) Patent No.: US 6,429,822 B1
(45) Date of Patent: Aug. 6, 2002

(54) MICROWAVE PHASE-SHIFTER AND ELECTRONIC SCANNING ANTENNA WITH SUCH PHASE-SHIFTERS

(75) Inventors: Philippe Naudin, Sevres; Michel Soiron, Chavenay; Claude Chekroun, Gif S/Yvette, all of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/820,645

(22) Filed: Mar. 30, 2001

(30) Foreign Application Priority Data

Mar. 31, 2000 (FR) ..... 00 04140

(51) Int. Cl.[7] ..... H01Q 3/26

(52) U.S. Cl. ..... 343/754; 343/854; 343/786

(58) Field of Search ..... 333/157; 342/372, 342/6, 16, 384; 343/754, 853, 776, 854, 786

(56) References Cited

U.S. PATENT DOCUMENTS

| | | | | |
|---|---|---|---|---|
| 4,044,360 | A | 8/1977 | Wolfson et al. | 343/754 |
| 4,212,014 | A | 7/1980 | Chekroun | 343/754 |
| 4,320,404 | A | 3/1982 | Chekroun | 343/854 |
| 4,344,077 | A | 8/1982 | Chekroun et al. | 343/754 |
| 4,447,815 | A | 5/1984 | Chekroun et al. | 343/754 |
| 4,568,893 | A | 2/1986 | Sharma | 333/157 |
| 5,001,495 | A | 3/1991 | Chekroun | 343/754 |
| 5,144,327 | A | 9/1992 | Chekroun et al. | 343/731 |
| 5,153,602 | A | 10/1992 | DuBois et al. | 343/853 |
| 5,237,328 | A | 8/1993 | Dorey et al. | 342/13 |
| 5,548,289 | A | 8/1996 | Chekroun et al. | 342/16 |
| 5,598,172 | A | 1/1997 | Chekroun | 343/754 |
| 5,635,939 | A | 6/1997 | Chekroun | 342/384 |
| 5,680,136 | A | 10/1997 | Chekroun | 342/6 |
| 6,191,748 | B1 | 2/2001 | Chekroun et al. | 343/754 |
| 6,198,433 | B1 | 3/2001 | Herault et al. | 342/372 |

OTHER PUBLICATIONS

Wayne W. Lam, et al. "Millimeter–Wave Diode–Grid Phase Shifters," IEEE Transactions on Microwave Theory and Techniques, vol. 36, No. 5, May 1988, pp. 902–907.

U.S. application No. 07/349,382, filed Mar. 30, 1989.

U.S. application No. 09/820,645, filed Mar. 30, 2001, pending.

U.S. application No. 09/890,932, filed Aug. 06, 2001, pending.

*Primary Examiner*—Don Wong
*Assistant Examiner*—James Clinger
(74) *Attorney, Agent, or Firm*—Oblon, Spivak, McClelland, Maier & Neustadt, P.C.

(57) ABSTRACT

A microwave phase-shifter including a coupler in a waveguide form, at least one pair of phase-shifter cells, and a conductive strip positioned between each phase shifter cell and configured with a conductive plane to form a guided space where a wave cannot propagate. An incident wave entering a first input of the coupler is subdivided into two waves. Each of the waves are reflected on an elementary cell with identical phases to the incident wave and are recombined into a resultant phase-shifted wave prior to exiting the coupler by an output juxtaposed with the first input.

15 Claims, 5 Drawing Sheets

MICROWAVE PHASE-SHIFTER AND ELECTRONIC SCANNING ANTENNA WITH SUCH PHASE-SHIFTERS

BACKGROUND OF THE INVENTION

The present invention pertains to a phase-shifter. It can be applied especially to an electronic scanning antenna. The invention can also be applied in particular to low-cost electronic scanning antennas used in radars, for example for the management of air traffic in airports, as well as in telecommunications, for example civilian telecommunications.

Passive electronic scanning antennas use phase-shifters for the to mobility of their beam. These phase-shifters can act directly on the radiated wave constituting what is known as a microwave lens. These phase-shifters can also act within an energy distribution device. The amplification of the wave to be transmitted is centralized and then the wave thus amplified is distributed towards the phase-shifters. There are single-plane electronic scanning antennas and two-plane electronic scanning antennas. A single-plane scanning antenna has a linear array of radiating sources each serially connected with a phase-shifter. The direction of the beam is then electronically controlled along a single plane, comprising radiating sources and a direction of radiation. To point a beam in a given direction θ, each phase-shifter is controlled so as to create a wave plane perpendicular to the direction of radiation θ. To obtain two-plane scanning, the linear array of radiating sources must be extended in a second direction.

Phase-shifters are elementary components that generally associate heterogeneous technologies to obtain microwave and control functions. The microwave functions are carried out especially by waveguides or ceramic substrates. The control functions are carried out especially by logic circuits and power circuits. These different functions are dissociated and require interconnections. The control of a group of phase-shifters also requires interconnections. This results in high costs for making these phase-shifters and therefore for making the electronic scanning antennas that comprise them. This is especially so because the number of phase-shifters is great.

SUMMARY OF THE INVENTION

An aim of the invention especially is to enable the making of a low-cost electronic scanning antenna. To this end, an object of the invention is a microwave phase-shifter comprising at least one 3 dB coupler in waveguide form and one pair of phase-shifter cells. The incident wave E enters a first input of the coupler and gets divided into two waves E1, E2, each of these two waves getting reflected on one elementary cell with identical phases and getting recombined into a resultant phase-shifted wave coming out by the output of the coupler juxtaposed with the first input.

Advantageously, to obtain an even more compact and economical phase-shifter, an elementary phase-shifter cell comprises a phase-shifting circuit and a conductive plane positioned substantially in parallel to the phase-shifting circuit, the phase-shifting circuit comprising at least two half phase-shifters, the incident waves E1, E2 being linearly polarized along a first given direction Oy. A half-phase-shifter comprises at least one dielectric support, at least two electrically conductive wires substantially parallel to the given direction Oy, positioned on the support and each bearing at least one semiconductor element with two states D1, D2, each wire being connected to control conductors of the semiconductor elements, these conductors being substantially normal to the wires, and two conductive zones positioned towards the periphery of the cell, substantially parallel to the control conductors. The control conductors are at least three in number in each half-phase-shifter and are electrically insulated from one half-phase-shifter to another, to control the state of all the semiconductor elements independently of one another. The geometrical and electrical characteristics of the half-phase-shifters are such that each of the states of the semiconductor elements has a corresponding given value of phase shift ($d\phi_1, \ldots, (d\phi_8)$ of the electromagnetic wave which is reflected by the cell, the state of the semiconductor elements being controlled by an electronic circuit.

The dielectric support may advantageously bear the electronic control circuit of the semiconductors and their interconnections, these semiconductors being for example diodes.

An object of the invention is also an electronic scanning microwave antenna comprising phase-shifters as defined here above.

Advantageously, the phase-shifters are distributed into at least one block, one block comprising a set of pairs of phase-shifter cells made on one and the same part and a set of couplers forming a single part. This arrangement provides, in particular, for testing the phase-shifters in batches. Any malfunctioning phase-shifter block can easily be replaced by another. The test and maintenance of the antenna are thus in particular simplified and their reliability is increased.

BRIEF DESCRIPTION OF THE DRAWINGS

Other features and advantages of the invention shall appear from the following description made with reference to the appended figures, of which.

MORE DETAILED DESCRIPTION

Figure 1:
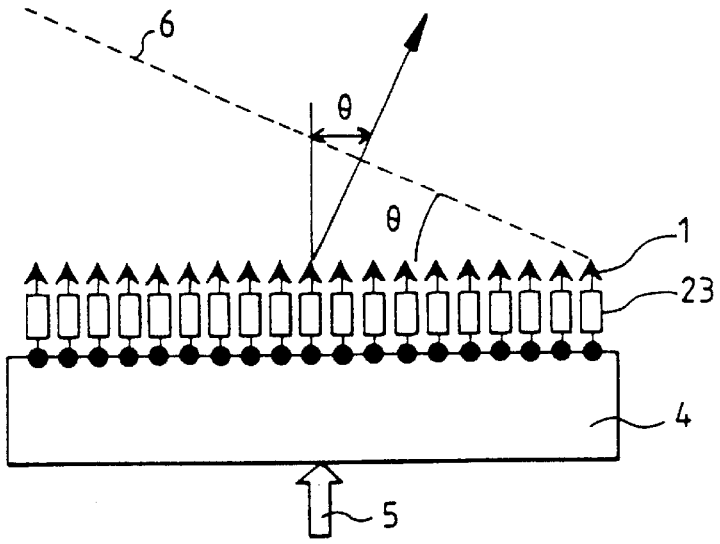
FIG. 1 is a block diagram showing the structure of an electronic scanning antenna powered by a centralized power transmitter.

FIG. 1 is a block diagram showing a single-plane electronic scanning antenna. This antenna has a linear array of phase-shifters where the microwave is amplified by a centralized transmitter. The network comprises radiating sources 1, each associated with a phase-shifter 23. Each phase-shifter 23 is, for example, supplied by distribution means, i.e. it receives the microwave given by these distribution means 4 from the microwave 5 given by the transmitter. At reception, the received wave is transmitted to the reception circuits by the distribution means 4. Each phase-shifter is controlled so as to create a wave plane 6 perpendicular to the direction of radiation θ, this angle defining the direction of aim of the antenna beam in the plane of the radiating sources 1.

Figure 2A:
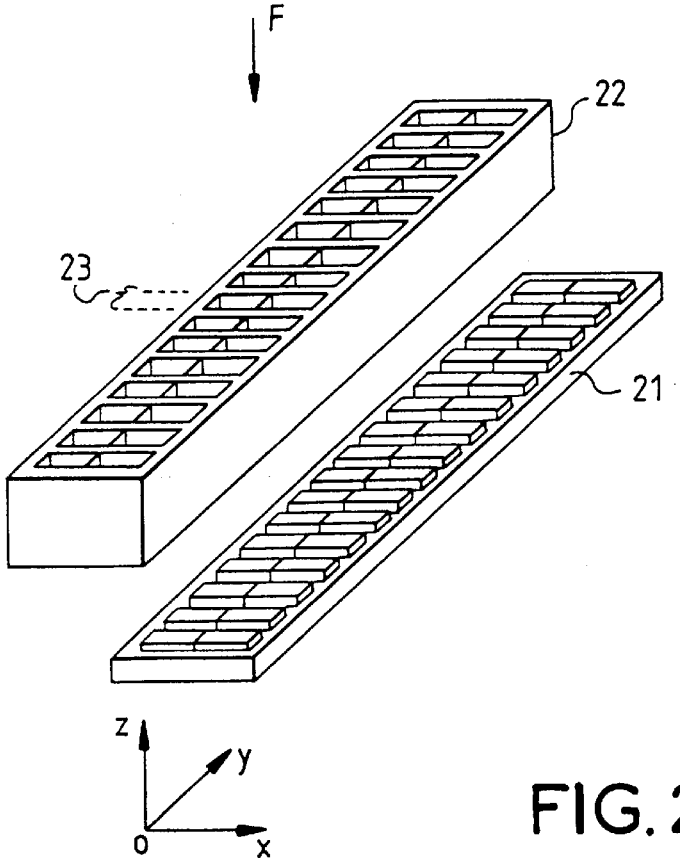
FIGS. 2*a* and 2*b* are exemplary embodiments of phase-shifters according to the invention.
Figure 2B:
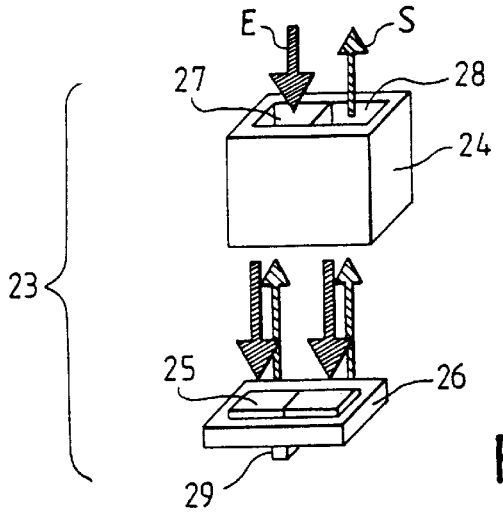

FIGS. 2*a* and 2*b* illustrate a possible embodiment of an antenna according to the invention. More particularly, these figures illustrate the making of phase-shifters 23 according to the invention. In this embodiment, the cost is limited and the implementation of the phase-shifters and, more generally, that of the antenna is considerably simplified. To this end, a support or multiple-layer printed circuit 21 forming a phase-shifter device shown in a plane Oxy is associated, for example, with a coupling device 22 in waveguide form. This makes it possible especially to make and test phase-shifters in batches and hence to greatly reduce the cost and facilitate their integration into the antenna.

FIG. 2*b* illustrates a part 23 of FIG. 2*a*. This part in fact represents an elementary phase-shifter according to the invention. FIG. 2*b* illustrates especially a 3 dB coupler in the form of a waveguide 24 associated with a pair of phase-shifter cells 25, 26. The elementary phase-shifter 23 is therefore made by associating the 3 dB coupler 24 to a pair of cells 25, 26 of the phase-shifter device 21 working in reflection. In particular, the incident wave E passing through a first input 27 of the coupler 24 gets divided into two incident waves E1, E2 towards the two phase-shifter cells 25, 26. These two cells reflect the incident waves with identical phase shifts. The reflected waves enter the coupler and get recombined with each other and the resultant wave S, phase-shifted with respect to E, is found at the output 28 of the coupler, juxtaposed with the first input 27. The phase-shifter device constituted by the two cells 25, 26 is equivalent to two variable electrically-controlled short circuits. This device is made for example on the support 21 comprising semiconductors facing the coupler to provide for its phase shifting. Furthermore, the control circuits 29 of these semiconductors are, for example, implanted on this same support on its face opposite the semiconductors, the multilayer support then providing for the interconnections between the control circuits and the semiconductors. These semiconductors are, for example, diodes. The incident microwave E entering the counter is, for example, derived from the distribution circuit 4.

FIG. 2*a* shows an exemplary phase-shifter device 21 where the pairs of elementary cells 25, 26 are made on one and the same part, for example of the printed circuit type. The couplers 24 associated with the circuit of these pairs may form a single part 22 as shown in FIG. 2*a*. This part 22 is then attached to the phase-shifter device 21. The guides forming the couplers are for example machined in one and the same metallic part. However, it is naturally possible to make a phase-shifter according to the invention that is not made in batches, as shown for example in FIG. 2*b*. The making of the couplers, individually or in batches, may make use, for example, of molding techniques, injection techniques or again techniques for the metallization of plastic parts, thus reducing costs.

Figure 3A:
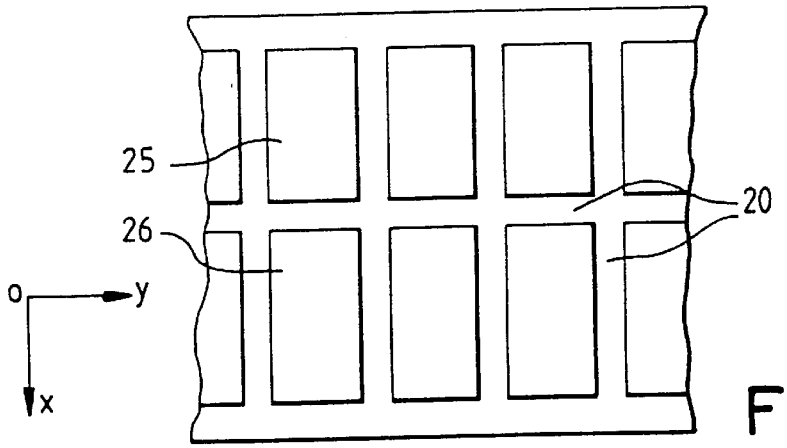
FIGS. 3*a* and 3*b* are the structure of a printed circuit comprising phase-shifters according to the invention and their associated commands.
Figure 7:
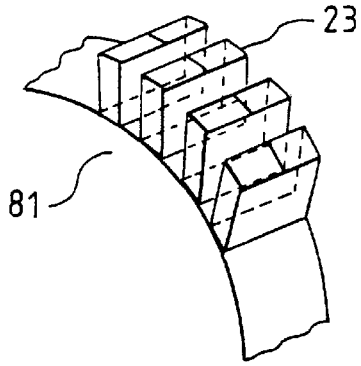
FIGS. 7 and 8 are exemplary embodiments of phase-shifter blocks.
Figure 8:
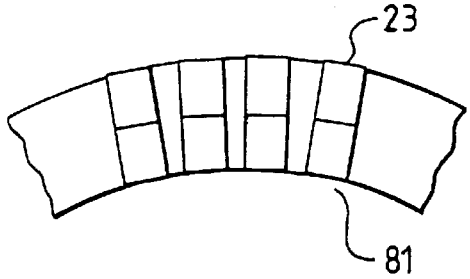

FIG. 3*a* gives a schematic view of a part of the phase-shifter device shown in the plane Oxy by a top view along F. This phase-shifter device has an alignment of pairs of phase-shifter cells 25, 26 forming a linear array of pairs of phase-shifter cells. It must be noted that other forms of alignment can be made, especially on a circle to form a cylindrical antenna as can be seen in FIGS. 7 and 8 hereinafter. In association with a 3 dB coupler, a pair forms an elementary phase-shifter 23 as described with reference to FIG. 1 . The phase-shifter cells 25, 26 are separated by zones 20 used especially for the microwave decoupling of these cells. These cells carry out the reflection and phase-shifting of the waves that they receive. An elementary cell 25, 26 comprises a phase-shifter microwave circuit positioned before a conductive plane.

Figure 3B:
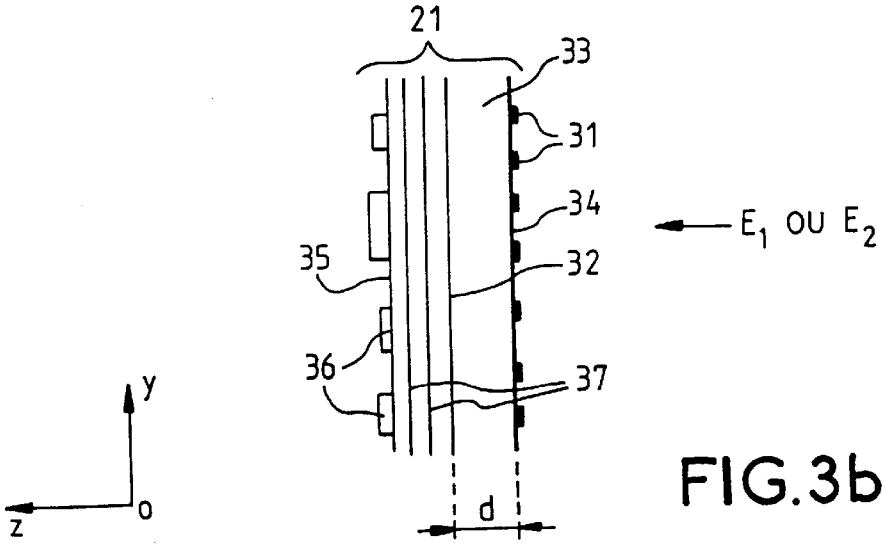

FIG. 3*b* is a schematic sectional view, in the plane Oxz, of an exemplary possible embodiment of the phase-shifter device. The phase-shifter device consists of a microwave circuit 31 distributed in the elementary cells 25, 26 and a conductive plane 32 positioned substantially parallel to the microwave circuit 31, at a predefined distance d. This microwave circuit receives the incident waves E1 and E2 coming from the coupler 24.

The conductor plane 32 especially has the function of reflecting the microwaves. It may consist of any known means, for example parallel wires or a grid arrangement, that is sufficiently tight or in a continuous plane. The microwave circuit 31 and the conductive plane 32 are preferably made on two faces of a dielectric support 33, for example of the printed circuit type. The set 21 also comprises, preferably on one and the same circuit 33, which is then a multilayer circuit, the electronic circuit needed to control the phase value. FIG. 3*b* shows a multilayer circuit whose front face 34 bears the microwave circuit 31, while its rear face 35 bears the components 36 of the above-mentioned electronic control circuit, and its intermediate layers form the conductive plane 32 and, for example, two planes 37 of interconnections of the components 36 to the microwave circuit 31.

Figure 4:
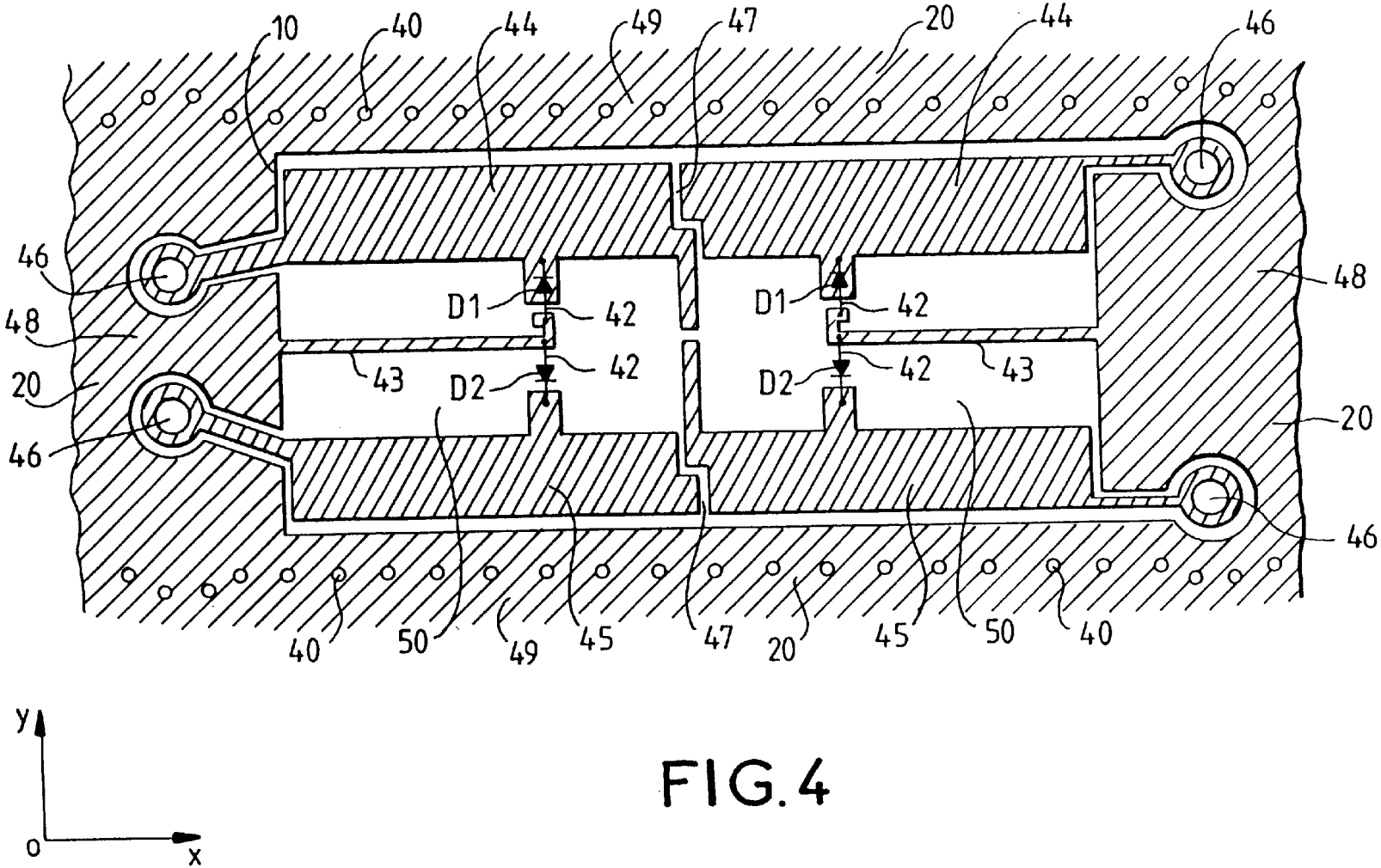
FIG. 4 shows a first exemplary embodiment of an elementary cell of a phase-shifter according to the invention.

FIG. 4 illustrates an elementary phase-shifter circuit 10 included in the microwave circuit 31. Each phase-shifter circuit is separated from another by a decoupling zone 20 comprising, for example, a conductive strip 48 parallel to the direction Oy and a conductive strip 49 parallel to the direction Ox. It therefore has, for example, on its periphery, two conductive strips 48 in the direction Oy and two conductive strips in the direction Ox. Each phase-shifter circuit associated with the corresponding part of the conductor plane 32 forms a phase-shifter cell 25, 26.

A phase-shifter circuit 10 has several conductive wires 42 that are substantially parallel to the direction Oy, each conductive wire 42 bearing a semiconductor element D1, D2 with two states, for example a diode. The phase-shifter circuit furthermore comprises conductive zones connecting the diodes to reference potentials and control circuits. More particularly, a phase-shifter circuit consists of two circuits 50 hereinafter called half-phase-shifters. A half-phase-shifter will therefore be described in a first stage.

A half-phase-shifter 50 comprises a dielectric support 33, two wires 42 each having a diode D1, D2. The two wires are connected to the ground potential or to any other reference potential by means of a conductive line 43. This line 43 is, for example, a microstrip type of line made by metal deposition on the front face of the dielectric support 33, for example by a silkscreen technique. The diodes D1 and D2 are thus wired in opposition so that, for example, their anodes are connected to the ground potential by this line 43. To this end, this line 43 is connected for example to a conductive strip 48 of the decoupling means 20. The supply voltage of the diodes D1 and D2 is conveyed by control conductors 44. Since the anode of the diodes is connected to the ground potential, the control conductors are centered to the cathodes of the diodes. The supply voltage conveyed by these conductors is, for example, in the range of −15 volts. The control conductors are controlled so as to have at least two voltage states. In a first state, their voltage is for example the supply voltage, which turns the diode on, or in other words makes it forward-biased. In a second state, their voltage is such that the diode is blocked, or in other words reverse-biased. The controls of two control conductors 44, 45 are independent of each other so that the diodes can be controlled independently of one another. The control conductors 44, 45 and the grounded conductor 43 are substantially parallel to the direction Ox and therefore perpendicular to the wires 42. In FIG. 4, the ground conductor 43 is common to the two wires, especially to obtain compactness and a gain in the amount of material required. However it is possible to provide for a specific conductor for each wire. It is also possible to plan to connect these conductors not only directly to a reference potential but also by means of a control circuit.

The control conductors 44, 45 are connected to the electronic control circuit borne by the reflector by means of metal holes 46 made for example on the decoupling zone 20, especially for reasons of space requirement but also so not to disturb the working of the elementary cells. The metallized holes 46 are of course electrically isolated from the conductive strips of the decoupling zone. To this end, an interruption of the strip is provided 20 around the ends of the control conductors directly connected to the metallized holes 46.

A half-phase-shifter 50 may have four different values for its susceptance $B_D$, these values being referenced $B_{D1}$, $B_{D2}$, $B_{D3}$ and $B_{D4}$ depending on the command (direct bias or reverse bias) applied to each of the diodes D1, D2. The values of the susceptances $B_{D1}$, $B_{D2}$, $B_{D3}$ and $B_{D4}$ are a function of parameters of the circuit, namely of the values chosen for the geometrical parameters, especially as regards the dimensions, shapes and spacing values of the different conductive surfaces 43, 44, 45, and the electrical parameters of the phase-shifter especially with regard to the electrical characteristics of the diodes. In particular, it is necessary to take account of the constraint of defining the conductive strip of the decoupling zone 20 evoked here above with reference to the determining of the different parameters for fixing the phase-shifters $d\phi_1$–$d\phi_4$.

If we now study the behavior of the entire phase-shifter 50 in association with the conductor plane 32, we have to take account of the susceptance of this plane 32, carried into the plane of the phase-shifter and referenced $B_{CC}$, which can be written as follows:

$$B_{cc} = -\text{cotg}\frac{2\pi d}{\lambda} \tag{1}$$

where $\lambda$ is the wavelength corresponding to the pulsation $\omega$ here above.

The susceptance $B_C$ of the cell is then given by:

$$B_C = B_D + B_{CC} \tag{2}$$

It follows that the susceptance $B_C$ may take four distinct values (referenced $B_{C1}$, $B_{C2}$, $B_{C3}$ and $B_{C4}$) corresponding respectively to the four values of $B_D$, the distance d rep resenting an additional parameter to determine the values $B_{C1}$–$B_{C4}$.

It is also known that the phase-shifter $d\phi$ conveyed by an admittance Y to a microwave has the following form:

$$d\phi = 2 \text{ arctg } Y \tag{3}$$

It can thus be seen that, by neglecting the real part of the admittance of a cell, we get:

$$d\phi \approx 2 \text{ arctg } B_C \tag{4}$$

and that four possible phase-shift values $d\phi_1$–$d\phi_4$ are obtained per half-phase-shifter 50 depending on the command applied to each of the diodes $D_1$ and $D_2$. The different parameters are chosen so that the four values $d\phi_1$–$d\phi_4$ are equally distributed, for example but not obligatorily as follows: 0°, 90°, 180°, 270°. These four states correspond to a numerical control encoded on two bits.

It must be noted that here above we have described a case where the parameters of the circuit are chosen so that the zero susceptance values (or substantially zero susceptance values) are such that they correspond to the forward-bias diodes. But, of course, it is possible to choose a symmetrical operation. More generally, it is not necessary that one of the susceptance values $B_D$ or $B_r$ should be zero, these values being determined so that the conditions of equal distribution of phase shifts $d\phi_1$–$d\phi_4$ are fulfilled.

To show how an elementary cell 25, 26 enables eight possible phase shifts, namely a control of the phase shifts on three bits, we shall now consider the set of two half-phase-shifters 50. By making the two half-phase-shifter 50 work independently of each other, it is possible to obtain twice as many states, namely twice as many phase shifts, as with a single phase-shifter. Nevertheless, for this purpose, it is necessary to provide for electrical insulation between the two half-phase-shifters. These two half-phase-shifter are for example juxtaposed and the control conductors 4, 45 are insulated for example by a dielectric line 47 corresponding in fact to a cut-off line in the metallization of the conductors 44, 45. This first insulation in fact provides the insulation of the electrical controls of the diodes.

At the four susceptance values $B_{D1}$, $B_{D2}$, $B_{D3}$, $B_{D4}$ obtained by the influence of a phase-shifter, we therefore obtain four new values $B'_{D1}$, $B'_{D2}$, $B'_{D3}$, $B'_{D4}$. These four new values are obtained by the influence of the second phase-shifter.

The geometrical and electrical parameters of the phase-shifter are for example defined to obtain eight phase shifts equally distributed between 0° and 360°.

Depending on the desired phase shifts, the susceptance values $B_c$ and, therefore, the susceptance values $B_D$ are defined according to the relationships (1) and (2), the distance d being known. The geometrical and electrical parameters of the phase shift can then be obtained by conventional simulation means.

A phase-shift circuit as shown in FIG. 4 is simple to implement. It can indeed be used to obtain eight phase shifts by simply playing on the geometrical parameters of conductors and on the choice of diodes. The phase-shifter device 21, which comprises an array of pairs of phase-shifter cells, can therefore be obtained economically. The printed circuit supporting the microwave circuits and the electronic control circuits is furthermore thin.

As indicated here above, the phase-shifter device has decoupling means 20 between the cells 25, 26. The microwave E received by the cells is linearly biased, parallel to the direction Oy. It is desirable that this wave should not be propagated from one cell to another, in the direction Ox. To prevent a propagation of this kind, the decoupling means comprise at least the conductive zone 48. It is therefore planned to position this conductive zone 48 substantially in the form of a strip, made by metal deposition on the surface 34 for example, between the cells parallel to the direction Oy. This strip 48, with the reflector plane 32 which is beneath it, forms a waveguide type of space whose width is the distance d. The distance d is chosen so that it is smaller than $\lambda/2$, $\lambda$ being the length of the microwave, it being known that a wave whose polarization is parallel to the strips cannot get propagated towards a space of this kind. In practice, the reflector according to the invention works in a certain frequency band and d is chosen so that it is smaller than half of the smallest of the wavelengths of the band. Naturally, this constraint must be taken into account when determining the different parameters to fix the phase shifts $d\phi_1, \ldots, d\phi_8$. Furthermore, the strip 48 should have a width, along the direction Ox, sufficient so that the effect described here above shall be appreciable. In practice, the width may be in the range of $\lambda/5$.

Furthermore, it is possible, in a cell, to parasitically create a wave with a polarization directed along the direction Oz, perpendicular to the plane formed by the directions Ox and Oy containing a phase-shift circuit. It is also desirable to prevent its propagation to the neighboring cells.

With regard to the neighboring cells in the direction Ox, it is possible, as shown in FIG. 4, to use the metallized holes 46 for the connection of the control conductors to the electronic circuits. Indeed, since these circuits and conductors are parallel to the polarization of the parasitic wave, they are equivalent to a conductive plane forming a shielding if they are sufficiently close to each other (at the distance from one another that is much smaller than the operational wavelength of the reflector), hence numerous, for the operating wavelengths of the reflector. If this condition is not fulfilled, it is possible to form additional metallized holes that do not have a connection function. It must be noted that the metallized connection holes 46 are preferably made at the level of the strips 48 so not to disturb the operation of the cells. This arrangement furthermore provides a gain in compactness.

Finally, with regard to the two neighboring cells in the direction Oy, it is possible to use metallized holes 40 similar to the connection holes 46 but aligned in the direction Ox opening into the conductive strip 49. These metallized holes 40, like the metallized connection holes 46, are made in a direction Oz substantially perpendicular to the plane Oxy. It is also possible to plan, for example, for a continuous conductive surface in the plane Oz.

Figure 5:
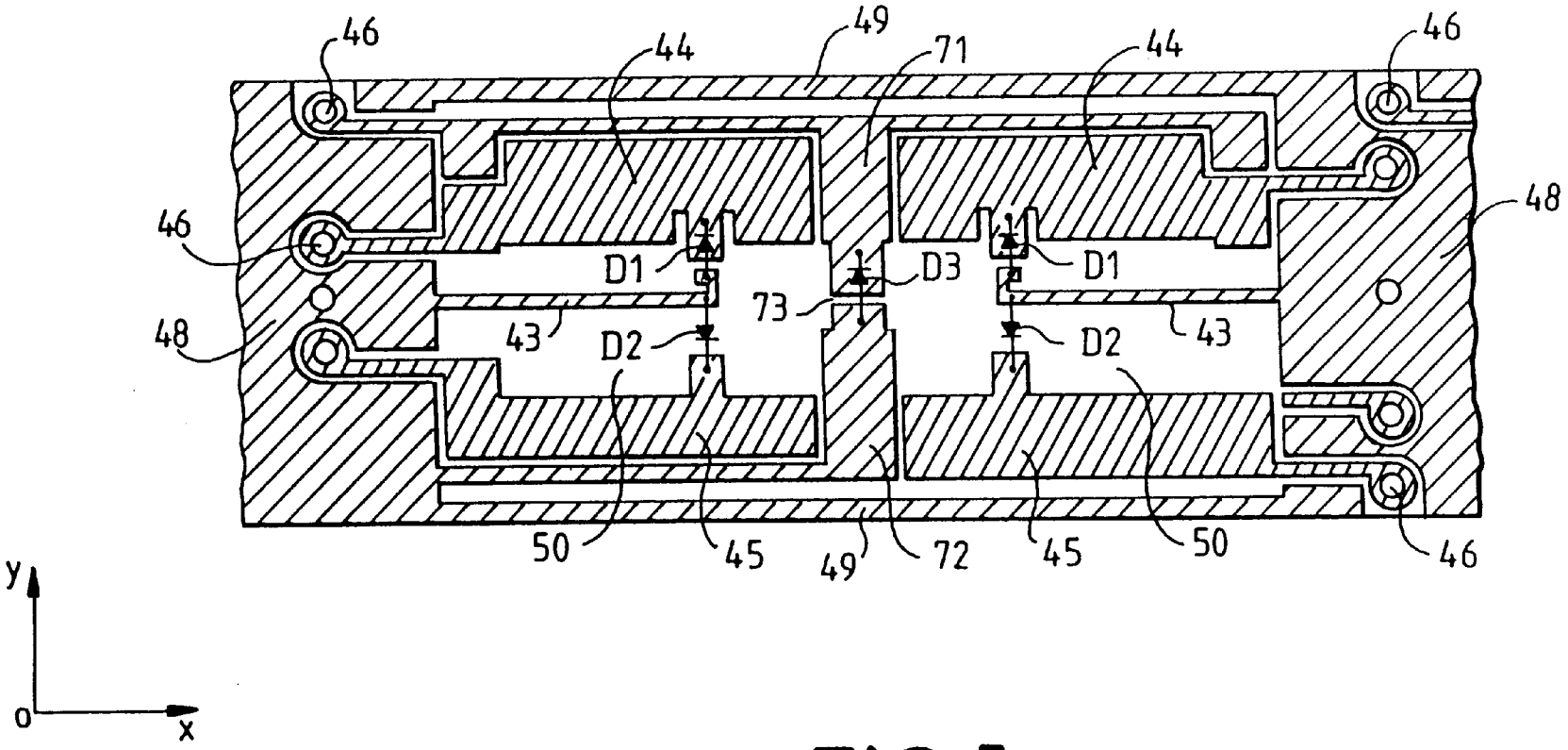
FIG. 5 shows a second exemplary embodiment of an elementary cell of a phase-shifter according to the invention.

FIG. 5 illustrates a phase-shifter according to the invention used to control the phase shifts on 4 bits, hence on one additional bit as compared with the circuit illustrated in FIG. 4. The phase-shift circuit still comprises two half-phase-shifters 50 made as described here above. However, the two half-phase-shifters are no longer separated by a line 47 insulating the diode commands but by two conductive zones 71, 72 connected by a diode D3, or any other semiconductor with two states. These two zones 71, 72 are, for example, made by metal deposition on the front face 34 of the dielectric. These zones form control conductors of the diode D3. To this end, a conductive zone 71 is, for example, connected to the electronic control circuits by a metallized hole 46. Depending on the state of the electronic command, this zone 71 is at a power supply potential, for example −15 volts, or at another potential, for example the ground potential. The other conductive zone 72 is, for example, connected to the ground potential. To this end, it is for example connected to the conductive strip 48 parallel to the direction Oy of the decoupling means 20.

When the conductive zone 71 is controlled so as to place it at the ground potential, or more generally to turn the diode D3 off, namely to put it in a state of reverse bias, the phase-shift circuit is similar to that of FIG. 4. In this state, it has eight possible phase shifts. It is, of course, necessary to redefine its geometrical and electrical parameters because of the introduction of the additional zones 71, 72. When the conductive zone 71 has a potential that turns the diode D3 on, i.e. put it in forward bias, the electrical parameters of the phase-shift circuit are modified from the previous state. In particular, the capacitor formed by the space between the two conductive zones 71, 72 gets short-circuited by the diodes D3. The eight possible susceptance values of the previous state, controlled on three bits, are then modified by powering on the diode D3. The eight new susceptance values thus obtained give eight additional phase shifts. In all, 16 phase shifts are therefore possible. The geometrical and electrical characteristics of the two half-phase-shifters 50 and also of the additional conductive zones 71, 72 and of their diode D3 must be defined so as to obtain the sixteen phase shifts desired for each of the states of the diodes.

FIGS. 4 and 5 show possible exemplary embodiments of the phase-shifter device 21, and more particularly of the phase-shifter cells 25, 26. Other exemplary embodiments on multilayer supports can be envisaged. In general, the phase-shifter cells 25, 26 of one and the same pair, associated with a coupler 24, produce the same phase shift. They may therefore be controlled, for example, by one and the same circuit.

Figure 6:
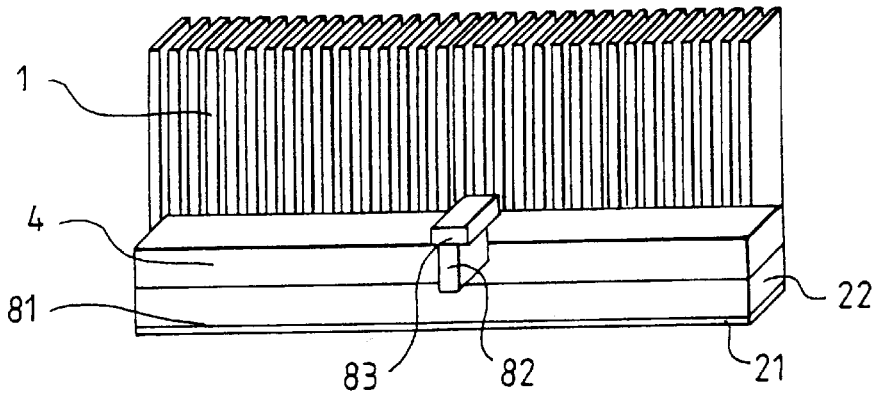
FIG. 6 shows an exemplary embodiment of an antenna according to the invention.

FIG. 6 illustrates an exemplary embodiment of an antenna according to the invention, comprising phase-shifters as described here above. The antenna has a linear array of phase-shifters carrying out, for example, an electronic -scanning operation in azimuth, for example in the context of an air traffic monitoring application. This antenna has energy distribution means 4, and means for the distribution of the microwave energy given by a power transmitter. It has radiating elements 1. Finally, it has a phase-shifter unit 81 itself consisting of phase-shifters according to the invention. This phase-shifter unit is, for example, the one illustrated in FIG. 2*a*. In this case, the pairs of phase-shifter cells 25, 26 are made on one and the same dielectric support. The dielectric support 33 is then common to all the cells. The phase-shifter unit therefore has a set of couplers 22 placed on a phase-shifter device 21 as illustrated in FIGS. 3*a*, 3*b* to 5. More particularly, the phase-shifter unit 81 is, for example, constituted by several sets according to FIG. 2*a* positioned end to end. One set 21, 22 comprises several phase-shifters, for example 16 of them, shown in this FIG. 2*a*. For example, a phase-shifter unit comprising five sets 21, 22 then has 80 phase-shifters. The microwave links are such that the outputs of the distribution means 4 are connected to the inputs 27 of the couplers 24, which also form the inputs of the phase-shifters. Similarly, the outputs of these phase-shifters, which are the outputs 28 of the couplers, are connected to the radiating elements. Waveguides 82, 83 lead the microwave from the transmitter to the distribution circuit 4, and lead the same received wave up to the reception circuits. A first guide 82 corresponds, for example, to the sum channel of the antenna pattern and a second guide 83 corresponds for example to the difference channel, thus enabling angular deviation measurements.

In the exemplary embodiment of FIG. 6, the radiating sources are positioned linearly, i.e. in a rectilinear way. It is possible to plan for exemplary embodiments in which the radiating sources, and also the phase-shifters are not linearly aligned. Other exemplary embodiments are proposed in FIGS. 7 and 8.

FIG. 7 gives a partial view in perspective of an exemplary embodiment in which the phase-shifter unit 81 is cylindrical. It then consists in particular of elementary phase-shifters positioned side by side on a cylindrical surface. In particular, the phase-shifter device 21, in this case, has a cylindrical shape. FIG. 8 gives a partial view of an exemplary embodiment in which the phase-shifter unit 81 is ring-shaped. The elementary phase-shifters are then arranged in a ring, and the phase-shifter device, in this case, is ring-shaped. In this figure, they are seen from the top, i.e. for example from the microwave input side.

The transmitter which feeds the distribution circuits 4 may be a tube transmitter or a solid-state transmitter. The technological choice may depend especially on the values of power brought into play.

An antenna according to the invention, made for example according to FIG. 6, is economical and highly compact. It is especially economical because of the considerable simplification of the connections and the reduction in the number of building and assembly operations. It is also economical because of the simplification of the testing, final adjusting and maintenance processes. In particular, the phase-shifters can be tested in batches, resulting in a gain in time. In the event of problems, it is very easy to replace one phase-shifter by another. In particular, if a phase-shifter of one unit 21, 22 is malfunctioning, it is very easy to replace the set comprising this malfunctioning phase-shifter by another set of phase-shifters. The maintenance of the antenna is thus simplified.

The invention is particularly well suited to a "single-plane" electronic scanning antenna. However, it can be applied to a "two-plane" antenna. In particular, in the latter example, the support of the phase-shifter device 21 may contain, for example, several rows of pairs of phase-shifter cells 25, 26 instead of only one, to obtain especially a plane array of phase-shifters. Other means of supplying the couplers 24 are possible. In particular, the supply may be of the type known as the "Rattle Snake" supply, where the elementary phase-shifters 23 are positioned on a winding line. In this type of supply, the electrical field is perpendicular to the field corresponding to the supply by guide, namely it is parallel to the direction Ox of FIG. 4 instead of the direction Oy. It is then necessary to obtain a 90° rotation in the phase-shifters so that the orientation of the wires 42 bearing the diodes are in the direction of the electrical field. The power supply to the couplers 24 can also be obtained by active sources, both field directions being possible. In this case, the antenna comprises active microwave sources. One active elementary source is, for example, associated with each coupler 24.

If a smaller degree of savings and compactness are sufficient, the printed-circuit type phase-shifter device 21 may be replaced by ferrite circuits or any other type of phase-shifter circuit.

What is claimed is:

1. A microwave phase-shifter comprising:

a coupler in waveguide form;

at least one pair of phase-shifter cells, each pair of said phase-shifter cells comprising an elementary cell including a microwave phase-shifter circuit positioned before a conductive plane; and a conductive strip positioned between each elementary cell in a direction parallel to a first given direction (Oy) and configured with the conductive plane to form a guided space where an incident wave cannot propagate, wherein an incident wave entering a first input of the coupler is subdivided into two waves, each of said two waves being reflected on the elementary cell with identical phases to the incident wave and being recombined into a resultant phase-shifted wave prior to exiting the coupler by an output juxtaposed with the first input.

2. A phase-shifter according to claim 1, wherein the incident wave is linearly polarized along the first given direction (Oy), the conductive plane is positioned substantially in parallel to the phase-shifting circuit, and the phase-shifting circuit comprises at least two half-phase-shifters, each half-phase-shifter comprises at least one dielectric support, at least two electrically conductive wires substantially parallel to the given direction Oy, positioned on the support, and each bearing at least one semiconductor element with two states, each electrically conductive wire being connected to control conductors of the semiconductor elements, these conductors being substantially normal to the electrically conductive wires, and two conductive zones positioned towards the periphery of the elementary cell, substantially parallel to the control conductors, the control conductors being at least three in number in each half-phase-shifter and being electrically insulated from one half-phase-shifter to another, and configured to control a state of all the semiconductor elements independently of one another, geometrical and electrical characteristics of the half-phase-shifters being such that, to each state of the semiconductor elements, there corresponds a given value of phase shift ($d\phi_1, \ldots, d\phi_8$) of the electromagnetic wave that is reflected by the cell, the state of the semiconductor elements being controlled by an electronic control circuit.

3. A phase-shifter according to claim 2, wherein the two half-phase-shifters are separated by two conductive zones connected by a semiconductor elements with two states, at least one of the zones being connected to the electronic control circuit to control the state of the semiconductor, the geometrical and electrical states of the half-phase-shifters and of the conductive zones and of their semiconductor elements being such that, to each of the states of the semiconductor elements, there corresponds a given value of phase shift ($d\phi_1, \ldots, d\phi_8$) of the electromagnetic wave that is reflected by the cell.

4. A phase-shifter according to claim 2, wherein the dielectric support comprises a multilayer printed-circuit, with a first face bearing the microwave circuit, a first intermediate layer bearing the conductive plane and a second face bearing the components of the electronic control circuit.

5. A phase-shifter according to claim 4, wherein the dielectric support furthermore comprises at least one second intermediate layer bearing interconnections of the control circuit.

6. A phase-shifter according to claim 1, comprising:

metallized holes made in the dielectric support in a direction (Oz) perpendicular to a plane (Oxy) of the phase-shift circuit, at a distance from one another smaller than the electromagnetic wavelength, at least some of these metallized holes providing a link between an electronic control circuit and control conductors.

7. A phase-shifter according to claim 2, wherein the semiconductor elements are diodes.

8. An electronic scanning microwave antenna, comprising at least radiating elements of the phase-shifters according to claim 1 and means for the supply of these phase-shifters, the inputs of the couplers forming the inputs of the phase-shifters being connected to the power supply means, the outputs of the couplers being connected to the radiating elements.

9. An antenna according to claim 8, wherein the phase-shifters are distributed into at least one block, a block comprising a set of pairs of phase-shifter cells made on one and the same part and a set of couplers forming a single part.

10. An antenna according to claim 8, wherein the phase-shifters are distributed on a cylinder.

11. An antenna according to claims 8, wherein the phase-shifters are distributed on a ring.

12. An antenna according to claim 8, comprising:

a planar array of phase-shifters.

13. An antenna according to claim 8, wherein the supply means of the phase-shifters comprise means for the distribution of a microwave, given by a centralized transmitter.

14. An antenna according to claim 8, comprising active microwave sources supplying the phase-shifters.

15. An antenna according to claim 1, wherein said coupler comprises at least one 3 dB coupler.

* * * * *